US006451375B1

(12) United States Patent
Cotte et al.

(10) Patent No.: US 6,451,375 B1
(45) Date of Patent: Sep. 17, 2002

(54) PROCESS FOR DEPOSITING A FILM ON A NANOMETER STRUCTURE

(75) Inventors: John Michael Cotte, New Fairfield, CT (US); Kenneth John McCullough, Fishkill, NY (US); Wayne Martin Moreau, Wappinger, NY (US); John P. Simons; Charles J. Taft, both of Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/755,266

(22) Filed: Jan. 5, 2001

(51) Int. Cl.[7] ..... B05D 5/12; B05D 3/00; B05D 1/36

(52) U.S. Cl. ..... 427/58; 427/123; 427/126.1; 427/377; 427/405; 427/443.1; 438/678

(58) Field of Search ..... 427/58, 123, 126.1, 427/443.1, 377, 405; 438/675, 678, 761

(56) References Cited

U.S. PATENT DOCUMENTS 5,143,593 A * 9/1992 Ueno et al. ..... 205/291
5,789,027 A * 8/1998 Watkins et al. ..... 427/250
5,908,510 A 6/1999 McCullough et al.
5,989,787 A * 11/1999 Kanoh et al. ..... 430/324
6,040,628 A * 3/2000 Chiang et al. ..... 257/760
6,087,258 A 7/2000 Simpson et al.
6,087,729 A 7/2000 Cerofolini et al.
6,106,722 A 8/2000 Chew et al.
6,140,377 A 10/2000 Schwertfeger et al.
6,165,559 A * 12/2000 McClain et al. ..... 427/388.1

* cited by examiner

*Primary Examiner*—Michael Barr
(74) *Attorney, Agent, or Firm*—Scully, Scott, Murphy & Presser; Daniel P. Morris

(57) ABSTRACT

A process of depositing a thin film on a nanometer structure in which a coating, which may be an aerogel material or metallic seed layer, is prepared. The coating is combined with a supercritical composition to form a supercritical coating composition. The supercritical coating composition is deposited upon a nanometer structure under supercritical conditions. Supercritical conditions are removed whereby the supercritical composition is removed and the coating solidifies into a thin solid film.

11 Claims, 1 Drawing Sheet

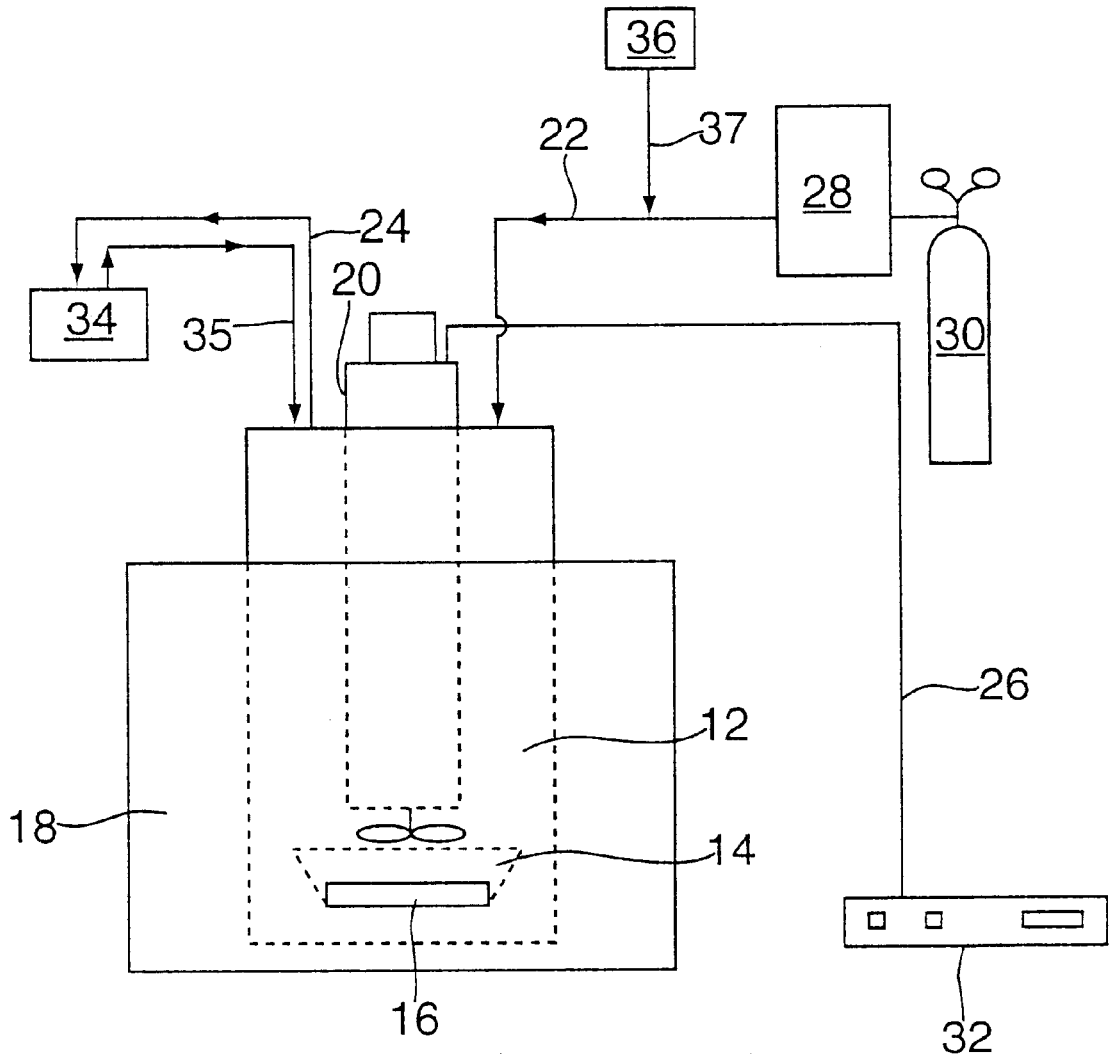
36
37
22
28
24
20
34
35
30
26
12
18
14
16
32

PROCESS FOR DEPOSITING A FILM ON A NANOMETER STRUCTURE

BACKGROUND OF THE DISCLOSURE

1. Field of the Invention

The present invention is directed to a process for depositing thin films in nanometer structures. More specifically, the present invention is directed to a process for depositing thin films in nanometer structures by utilizing supercritical carbon dioxide.

2. Background of the Prior Art

The application of thin films onto surfaces of nanometer structures, such as silicon wafers, microelectrical machines or other semiconductor devices, represents an evolving area of technology. In the past, two methods were primarily utilized to provide this function, chemical vapor deposition and ion sputtering. Both of these methods are highly effective in depositing films on flat surfaces of nanometer structures. However, these methods are not reliable enough when it is desired to provide a thin film coating on the surface of holes, trenches, vias and the like or if the surface to be coated is interrupted by holes, trenches, vias and the like. This is so because the vapor employed in these applications react with the structure to compromise the geometry of the holes, trenches, vias and the like.

The absence of reliability suggests the advisability of a third method of applying a thin film onto surfaces of a nanometer structure characterized by the presence of holes, trenches, vias and the like. This third method, spin coating, involves disposing an aerogel on a surface. The aerogel thereupon solidifies as a thin film. The aerogel is usually dissolved in a solvent and is applied, in spin coating, as a solution. An example of the preparation of an inorganic is illustrated in U.S. Pat. No. 6,140,377. U.S. Pat. No. 6,087,729 exemplifies film forming from inorganic aerogels. Although the problem of changes in nanometer structure geometry resulting from structure reaction with an ionic atmosphere does not arise in spin coating, this method presents its own unique reliability problem when spin coating is utilized in the forming a thin film on a nanometer structure.

This reliability problem resides in the inability to prevent film coating of the sides of the holes, trenches, vias and the like which results in filling the sides of these opening so that the opening is closed. This not only prevents the complete filling of the hole, trench, via and the like but, in addition, prevents the coating of a film on the surface of the base of the hole, trench, via and the like.

The above phenomena is scientifically explained by the relatively high surface tension of the thin film coating. This high surface tension makes it very difficult or even impossible for the film material to penetrate to the bottom of the hole, trench, via or the like. As such, the film material, which cannot penetrate to the bottom of the hole, trench, via or the like, builds up on the top portion of the sides of the hole, trench, via or the like which ultimately results in complete blockage of the opening.

Another problem in the prior art resides in deposition of metals, provide electrical conductivity, in nanometer structures containing trenches, vias and the like. To accomplish this deposition, a metallic seed layer must first be deposited in these holes. Techniques for depositing metallic seed layers, prior to catalyzed electroless deposition of metal, are described in U.S. Pat. Nos. 5,989,787, 6,087,258; and 6,106,722.

The problem associated with filling trenches, vias and the like with a metallic seed layer is identical to the problems associated with filling such holes with an aerogel spin coating. The sidewall deposition of the metallic seed layer often causes the hole to close in on itself prior to the complete filling of the trench, via or the like. The greater the aspect ratio, the more apt it is for this result to occur.

It is therefore apparent that the art is in need of a new process for providing thin films on nanometer structures in those cases where nanometer structures include holes, trenches, vias and the like so that those openings, in the course of coating such structures, do not plug or fill those openings.

SUMMARY OF THE INVENTION

A new process has now been developed for depositing thin films on nanometer structures. In this process the thin film is coated onto nanometer structures provided with holes, trenches, vias and the like without the resultant filing of the holes, trenches, vias and the like with the coating material. Instead, this method permits coating of the sides of the hole openings such that the base of the hole is coated without plugging by the coating on the hole's sides.

Although the invention is not limited to any theory explaining its operation, it is believed that a requirement must be met in order to overcome the difficulties discussed above. That is, a film forming material must be utilized which has a low enough surface tension to permit the fluid to penetrate into very narrow openings. The present invention provides an aerogel composition whose surface tension is low enough to enable the composition to completely coat openings to their bottom without plugging.

In accordance with the present invention a process is provided for deposition of a thin film on a nanometer structure in which a supercritical aerogel material or metallic seed layer, which solidifies into a thin film, is prepared. In this process an aerogel material or a metallic seed layer, which solidifies into a film, is prepared. The aerogel material or metallic seed layer is combined with a supercritical composition to form a supercritical aerogel composition. Thereupon, thermodynamic conditions are adjusted to eliminate supercritical conditions whereupon the supercritical composition is removed and the aerogel material or metallic seed layer solidifies into a solid film.

BRIEF DESCRIPTION OF THE DRAWING

The present invention will be better understood by reference to the accompanying FIGURE which is a schematic diagram of the apparatus employed in the present invention for depositing a thin film on a nanometer structure.

DETAILED DESCRIPTION OF THE INVENTION

The process of the present invention may be conducted in an apparatus 10 depicted in the FIGURE. Apparatus 10 includes a process chamber 12 having a sample zone 14 wherein a nanometer structure, noted by reference numeral 16, is disposed. The nanometer structure may be a silicon wafer, a microelectric machine or other semiconductor device. The process chamber 12 is surrounded by heater jacket 18 and may include stirring mechanism 20. Additionally, the process chamber contains inlet line 22, outduct 24 and thermocouple 26. The inlet line 22 contains a high pressure pump system 28 which is in communication with a gas cylinder 30 for supplying a supercritical fluid to the process chamber 12. Thermocouple 26 is also connected to a heat control unit 32 which is utilized for controlling and monitoring the temperature in the process chamber 12. Apparatus 10 may also include a reservoir 34 for collecting and/or purifying supercritical fluids that exit process chamber 12 through outduct 24. This material may then be recycled into the process chamber via duct 35.

Apparatus 10 is shown provided with a stirring mechanism. In this preferred embodiment, depicted generally at 20, the speed of the stirring unit varies from about 100 rpm to about 1000 rpm. More preferably, stirring occurs at about 500 rpm.

The term "supercritical" fluid refers to a fluid which is above its critical point, i.e., critical temperature, $T_c$, and critical pressure, $P_c$, so that the two fluid phases of a substance, liquid and gas, are in equilibrium with each other such that they become identical single phase. The supercritical fluid of the present invention comprises supercritical carbon dioxide and a co-solvent. The supercritical fluid co-solvent may be an alcohol, a ketone, a cyclic ether, N-methyl pyrrolidine or an acetonitrile.

The supercritical fluid, which comprises supercritical carbon dioxide and the co-solvent, is preferably present such that the co-solvent represents less than about 20% of the total volume of the supercritical fluid. More preferably, the supercritical fluid comprises between about 1% and about 10% co-solvent and the remainder supercritical carbon dioxide. The aforementioned percentages are by volume, based on the total volume of the supercritical fluid.

The purity of the supercritical fluid is not critical to the practice of the present invention. If a low purity supercritical fluid is employed, the supercritical fluid can be first purified to remove the impurities using techniques well known to those skilled in the art. For instance, a low purity supercritical fluid could be purified by passing it through a purification column prior to entering the processing chamber.

It is also emphasized that it is a supercritical composition that is employed in the present invention. The supercritical composition comprises the aforementioned supercritical fluid and a surfactant. The surfactant forms a homogeneous mixture with the supercritical fluid under the thermodynamic conditions extant in the process chamber 12. The surfactant may be introduced into the chamber 12 prior to the introduction of the supercritical fluid. In an alternate embodiment, a surfactant is maintained in a reservoir 36. Reservoir 36 is in communication with a conduit 37 which is also in communication with conduit 22. In this arrangement the surfactant is separately introduced into the process chamber 12 concurrent with the introduction of the supercritical fluid therein.

As shown in the FIGURE, the supercritical fluid may be pre-pressurized by a high pressure pump 28. Typically, the supercritical fluid is pre-pressurized to a pressure in the range of between about 1000 psi to about 6000 psi. More preferably, the supercritical fluid is pre-pressurized to a pressure of about 3000 psi before entering the processing chamber. The pre-pressurized supercritical fluid is then transferred to the processing chamber 12 through inlet line 22.

The nanometer structure 16 employed in the present invention is any semiconductor sample that may be subjected to spin coating. Illustrated examples of suitable nanometer structures that may be used in the present invention include, but are not limited to, semiconductor wafers, semiconductor chips, ceramic substrates, patterned film structures and the like. For example, the nanometer structure 16 may include one or more of the following materials: titanium silicide, tantalum nitride, tantalum silicide, silicon, polysilicon, silicon nitride, $SiO_2$, diamond-like carbon, polyimide, polyamide, aluminum, aluminum with copper, copper, tungsten, titanium, palladium, platinum, iridium, chromium, ferroelectric materials and high dielectric materials such as BaSrTi or PbLaTi oxides.

In practice, a nanometer structure 16 is placed in sample zone 16 of processing chamber 12 wherein the structure 16 is exposed to a supercritical aerogel or metallic seed layer composition. The supercritical aerogel or metallic seed layer composition includes an aerogel or a metallic seed layer and the aforementioned supercritical composition. The conditions in processing chamber 12 are such that the supercritical fluid is maintained above its critical temperature and pressure. As such, the aerogel or metallic seed layer composition is maintained at supercritical conditions. Typically, the pressure within processing chamber 12 is in the range of from about 1000 psi to about 6000 psi. More preferably, the pressure within processing chamber 12 is about 3000 psi. The temperature within the process chamber 12 is in the range of between about 40° C. to about 100° C. More preferably, the temperature within the process chamber during aerogel composition application is about 70° C.

It is emphasized that temperature conditions in process chamber 12 are controlled by heat control unit 32 which has the capability to monitor the temperature in chamber 12 by means of thermocouple 26. The measured temperature can be adjusted by heat jacket 18, controlled by controller 32, in accordance with temperature control means well known in the art.

To ensure effective penetration of the aerogel or metallic seed layer composition, the nanometer structure is exposed to the supercritical fluid under the above conditions for about 2 minutes to about 30 minutes. More preferably, the time period of exposure of the nanometer structure 16 to the supercritical fluid under the above-identified conditions is about 2 minutes.

Upon coating of the aerogel or metallic seed layer composition onto all the desired surfaces of the nanometer structure 16, the thermodynamic conditions in the process chamber 12 are adjusted so that the $CO_2$ is no longer in the supercritical state. This is preferably accomplished by a reduction in pressure to below supercritical pressure. Upon pressure reduction, the $CO_2$ immediately gasifies, entraining the co-solvent and surfactant. As such, only the aerogel, which solidifies, remains on the nanometer structure.

It is emphasized that the aerogel, which solidifies as a thin film in the nanometer structure, is a low density dielectric material obtainable by the gelling of a solution followed by supercritical solvent extraction. The formation of aerogels is well understood by those skilled in the art and the specific aerogel, other than it being maintained under supercritical conditions, is not an inventive feature of the process of the present invention.

It is furthermore emphasized that the metallic seed layer, which solidifies as a thin film in the nanometer structure, is a metal precursor comprised of metal chelates. Particularly preferred metal chelates include platinum or palladium acetyl actonates. These compounds are described in U.S. Pat. Nos. 5,989,787 and 6,087,258 incorporated herein by reference. Most preferably, the metal chelate is platinum or palladium perfluoroacetyl acetonate.

After deposition of the metallic seed layer, electroless metal deposition, to fill the trench, via or the like, which is coated with the metallic seed layer, occurs. To accomplish this task the metallic seed layer deposition process is repeated albeit employing a supercritical metal-containing composition which comprises a solution of the aforementioned supercritical composition and a metal-containing composition employed in electroless metal deposition.

The subcritical fluid exiting the process chamber through outduct 24 may be cleaned, as described above, and recycled back into the apparatus under supercritical conditions. In this manner a closed reactor system may be utilized. Such a closed reactor system is illustrated in the FIGURE. Such an apparatus may or may not be provided in the process of the present invention. Obviously, a closed reactor system reduces processing costs at the price of increased capital expense. In the preferred embodiment illustrated in the FIGURE, where such a system is employed, the exhaust subcritical fluid enters a reservoir 34 through conduit 24 and is recycled back into chamber 12 through conduit 35.

The above description of the present invention will make apparent, to those skilled in the art, other embodiments and examples. These other embodiments and examples are within the contemplation of the present invention. Therefore, the present invention should be limited only by the appended claims.

What is claimed is:

1. A process of depositing a film on a nanometer structure which comprises the steps of:

(a) preparing a coating selected from the group consisting of an aerogel material and an metallic seed layer which solidifies into a film;

(b) combining said coating with a supercritical composition to form a supercritical coating composition;

(c) depositing said supercritical coating composition, under supercritical conditions, into a nanometer structure; and (d) eliminating said supercritical conditions whereby said supercritical composition is removed and said coating solidifies into a solid film.

2. A process in accordance with claim 1 wherein said supercritical composition comprises a supercritical fluid and a surfactant.

3. A process in accordance with claim 2 wherein said supercritical fluid comprises supercritical carbon dioxide and a co-solvent.

4. A process in accordance with claim 3 wherein said co-solvent is selected from the group consisting of an alcohol, a ketone, a cyclic ether, N-methyl pyrrolidine and an acetonitrile.

5. A process in accordance with claim 1 wherein said coating is an aerogel material.

6. A process in accordance with claim 1 wherein said coating is a metallic seed layer.

7. A process in accordance with claim 6 wherein said metallic seed layer is a metal chelate.

8. A process in accordance with claim 7 wherein said metal chelate is a platinum or palladium acetyl acetonate.

9. A process in accordance with claim 6 comprising the further step of coating said metallic seed layer coated nanometer structure with a composition of a supercritical composition and a metal-containing composition employed in electroless metal deposition.

10. A process in accordance with claim 9 wherein said supercritical composition comprises a supercritical fluid and surfactant.

11. A process in accordance with claim 10 wherein said supercritical fluid comprises supercritical carbon dioxide and a co-solvent.

* * * * *